United States Patent [19]

de Páez et al.

[11] 4,008,806

[45] Feb. 22, 1977

[54] SORTER FOR YARN-LIKE MATERIALS

[75] Inventors: Consuelo R. de Páez; Stephen A. Páez, both of Pittsburg, Calif.

[73] Assignee: Consuelo R. de Páez, Pittsburg, Calif.

[22] Filed: Dec. 16, 1974

[21] Appl. No.: 533,023

[52] U.S. Cl. ..... 209/122; 206/388; 150/1; 66/1 A

[51] Int. Cl.[2] ..... B07C 7/00

[58] Field of Search ..... 209/122, 126; 206/388; 150/1, 1.5 R, 1.5 C, 34; 66/1 A, 1 R; 224/23, 26 B, 45 Q, 49

[56] References Cited

UNITED STATES PATENTS

| | | | |
|---|---|---|---|
| 1,699,945 | 1/1929 | Barry | 206/388 |
| 1,705,050 | 3/1929 | Taylor | 206/388 |
| 1,731,588 | 10/1929 | Patterson | 150/1.5 R |
| 2,582,447 | 1/1952 | Meyers | 150/34 |
| 3,054,277 | 9/1962 | Broschard | 66/1 A |
| 3,554,255 | 1/1971 | Mangan | 150/1.5 R |
| 3,674,072 | 7/1972 | Shuto | 150/1.5 R |

FOREIGN PATENTS OR APPLICATIONS

| | | | |
|---|---|---|---|
| 503,554 | 6/1951 | Belgium | 66/1 A |

*Primary Examiner*—Robert B. Reeves
*Assistant Examiner*—Joseph J. Rolla
*Attorney, Agent, or Firm*—Bielen and Peterson

[57] ABSTRACT

A device for the sorting, storage and transportation of yarn-like materials including a sack for containing the bulk of the yarn-like material and a sorting member placed in a portion of the bag to allow the free ends of the yarn to pass from the interior to the exterior of the bag separated from each other and readily available to the user.

10 Claims, 10 Drawing Figures

FIG-6
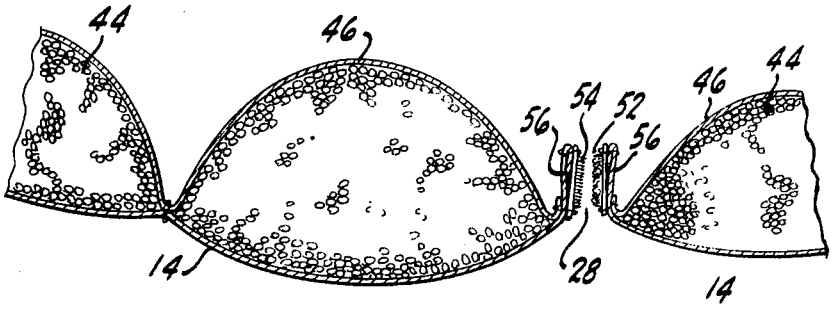
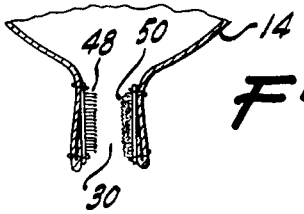
FIG-7
FIG-8
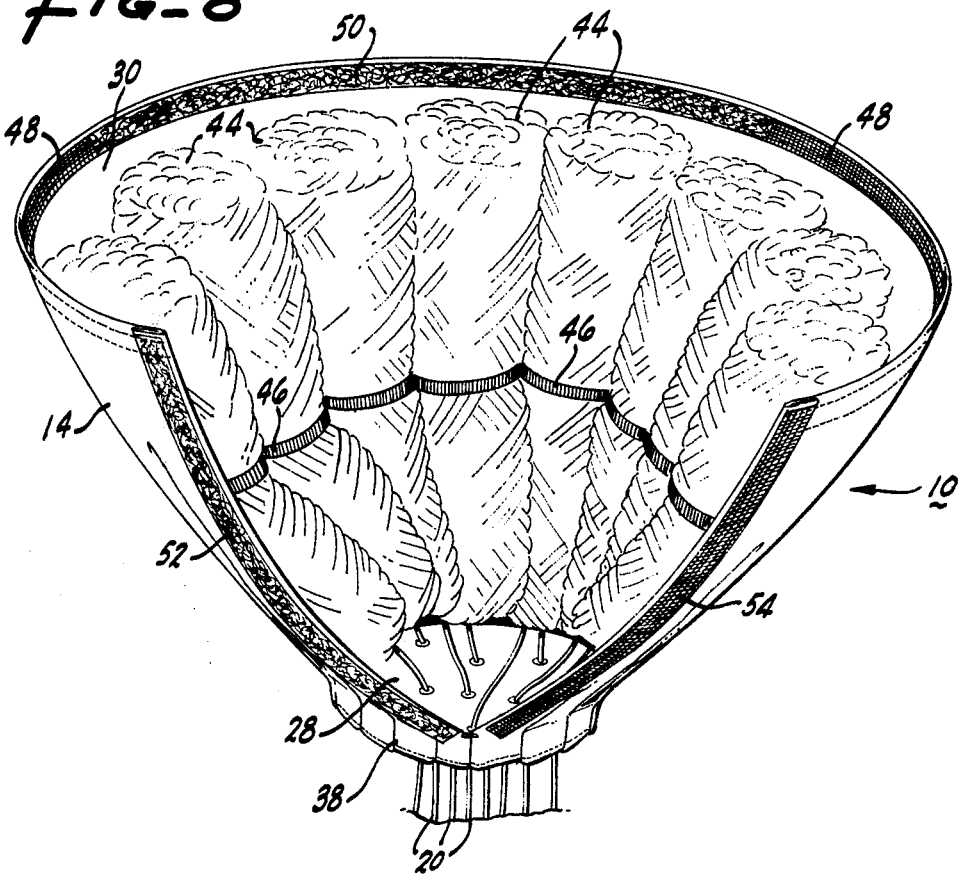

FIG-9
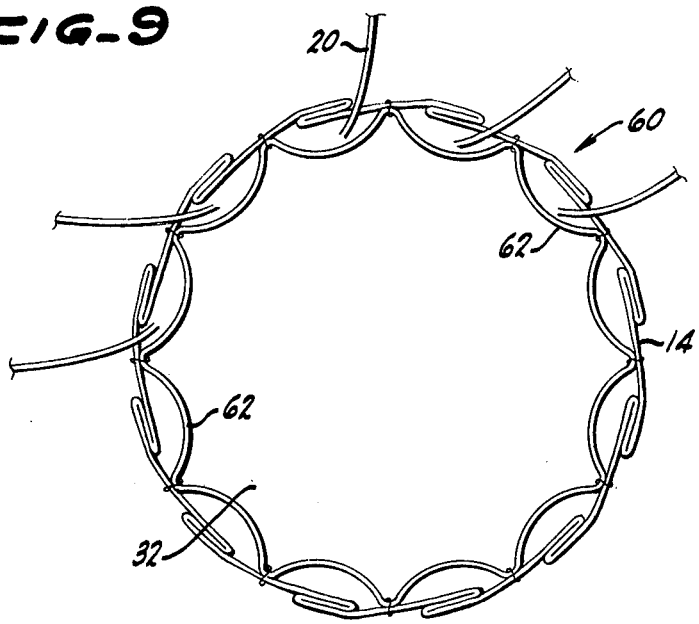
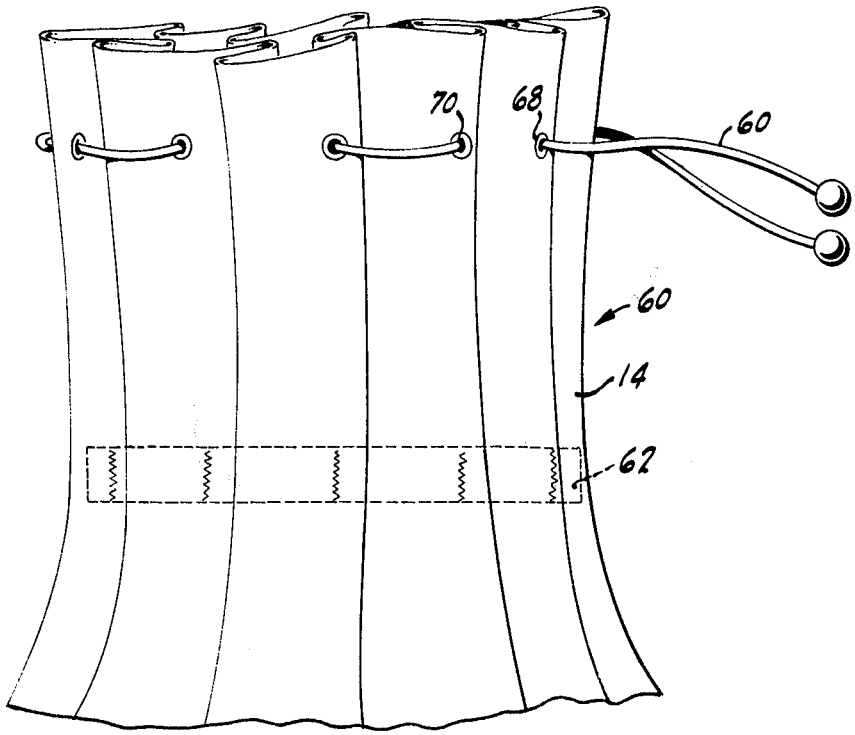
FIG-10

SORTER FOR YARN-LIKE MATERIALS

BACKGROUND OF THE INVENTION

The present invention relates to a novel apparatus for the sorting, carrying and general management of the materials and tools necessary for knitting, crocheting, crewel and any such activity requiring working with a plurality of tools and yarn-like raw materials. Such tool utilization is often obliged by the nature of the finished piece which contains a variety of yarns of different colors and sizes.

The prior practice has been to organize yarns into balls, which entails unwinding the original skeins—a time consuming process. The balls have been placed in a box or like container and run to the knitting or crocheting tools. This technique results in frequent chaotic entanglements of the yarns and confusion when the user attempts to find the proper yarns during the course of the work being performed.

In addition, the balls of yarn have often been exposed to dust, dirt, water, and the bleaching effect of sunlight. Also, children and pets have had access to the yarn which has resulted in serious, although inadvertant, damage to the yarn-like material.

SUMMARY OF THE INVENTION

In accordance with the present invention, a device is provided for the storage, sorting and transportation of yarn-like material and the like, tools for the working of such material, and other paraphernalia. The invention, in a general form, includes a bag preferably constructed of resilient fabric to contain the skeins or bulk yarn. Holding means, such as elastic bands, affix to the interior of the bag and hold the skeins to the interior surface of the bag. Closeable access openings placed adjacent to the skeins allow easy access to them. A sorting means, which may take the form of a series of holes in the body of the bag, permits the smooth travel of the free ends of the bulk yarn from the interior to the exterior of the bag for use.

Another embodiment of the invention includes providing a bag with a mouth and a relatively rigid sorting member disposed within the mouth. The rigid sorting member may be removably fixed to the bag in the vicinity of the mouth. Although the closure member may take any shape, one embodiment of the invention teaches a roughly disc-shaped piece containing a plurality of holes for passage of the free ends of the skeins to the exterior of the bag.

The invention also includes a handle to allow easy movement of the device and a plurality of pockets on the exterior of the bag to hold the tools used in working the yarn-like material and the workpiece.

It is, therefore, an object of the present invention to provide a device for the sorting and storage of yarn-like material, wire, cord, thread and the like.

It is a further object of the present invention to provide an apparatus for the efficient and facile handling and manipulation of yarn-like material.

It is yet another object of the present invention to provide a device to permit the use of yarn skeins without unwinding and rewinding the same.

Yet another object of the present invention is to provide a device which neatly organizes the yarn-like material, tools and workpiece of the type employed in knitting, crocheting, crewel and other like activities.

The invention possesses other objects and advantages, especially as concerns particular features and characteristics thereof, which will become apparent as the specification continues.

BRIEF DESCRIPTION OF THE DRAWINGS

FIG. 6 is a broken partial cross-sectional view along line 6—6 of FIG. 2.

FIG. 7 is a broken partial cross-sectional view along line 7—7 of FIG. 2.

FIG. 8 is a broken perspective view of the sorter revealing the interior construction of the bag portion.

FIG. 9 is a broken plan view of an alternate embodiment of the sorting means.

FIG. 10 is a broken side view of an alternate embodiment of the invention.

DESCRIPTION OF THE PREFERRED EMBODIMENT

Figure 1:
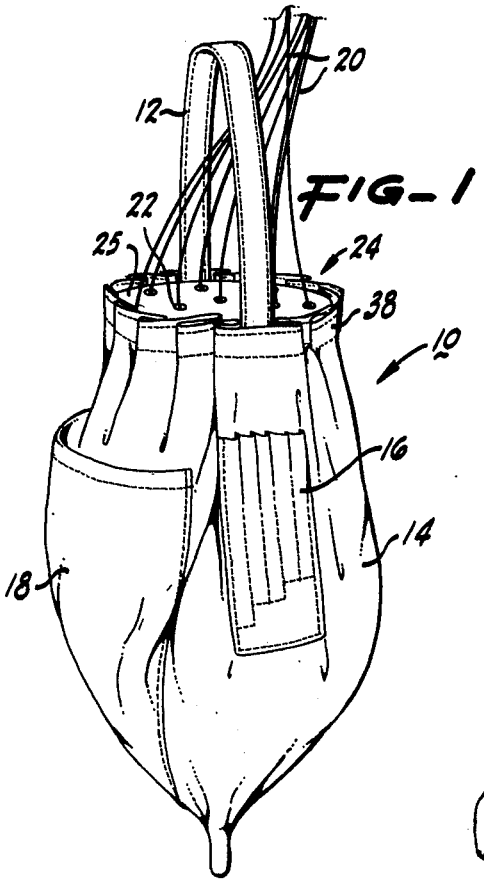
FIG. 1 is an end perspective view of the sorter.

With reference to FIG. 1, the device, in its entirety, is denoted by reference character 10 and includes a handle structure 12 affixed to bag 14 by any conventional means such as sewing, riveting, and the like. The exterior of bag 14 includes a pocket 16 to hold the tools associated with the work performed such as crochet hooks, knitting needles and similar devices. Likewise, a relatively large pocket 18 contains paraphernalia and the workpiece. Yarn-like material 20 exits from openings 22 on sorting means 24 which will be more fully explained as the specification continues.

Figure 2:
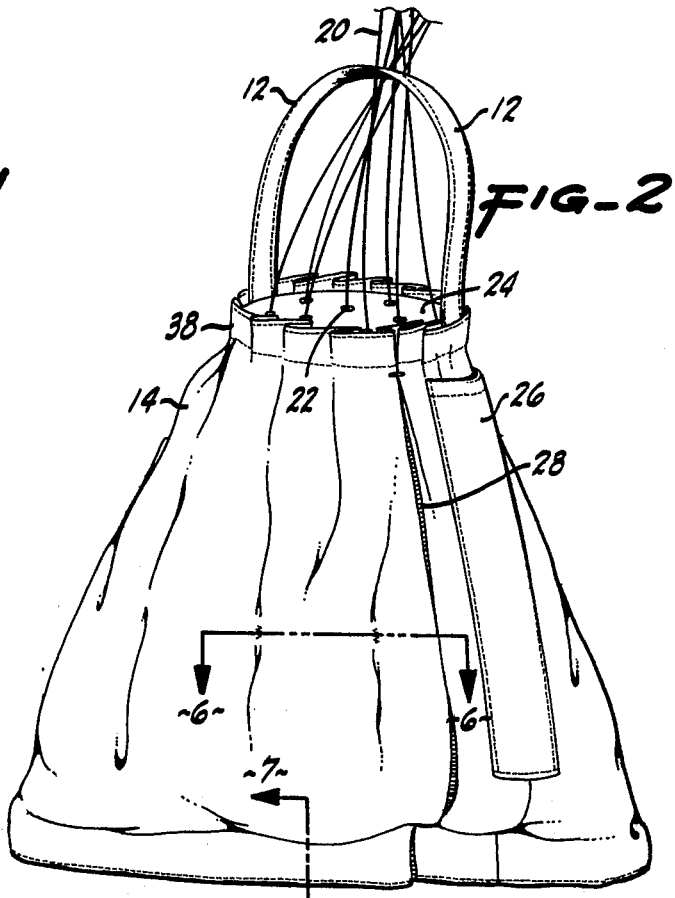
FIG. 2 is a side perspective view of the sorter.

FIG. 2 depicts another pocket 26 to contain bulky tools employed by the user. Running the height of the side of bag 14 is an opening 28. A second opening 30 opens substantially the entire bottom of the bag 14 to allow easy access to the interior of the bag 14. The interior periphery of mouth 32 of the bag 14 holds the sorting means 24, as most clearly shown in FIG. 3.

The means for sorting 24 the free ends of the yarn-like material 20 may have a sorting member 25 constructed of comparably rigid material such as wood, metal, plastic, and the like. Sorting means 24 is preferably removably attached to the bag 14. In the present embodiment, one means of attachment takes the form of a series of male snap members 34 mounted on bag 14 and female snap members 36 mounted on sorting member 25 in the conventional manner, including the use of backing strip 38. As is well known in the art, backing strip 38 is doubled over directly behind male snap member 34.

Figure 3:
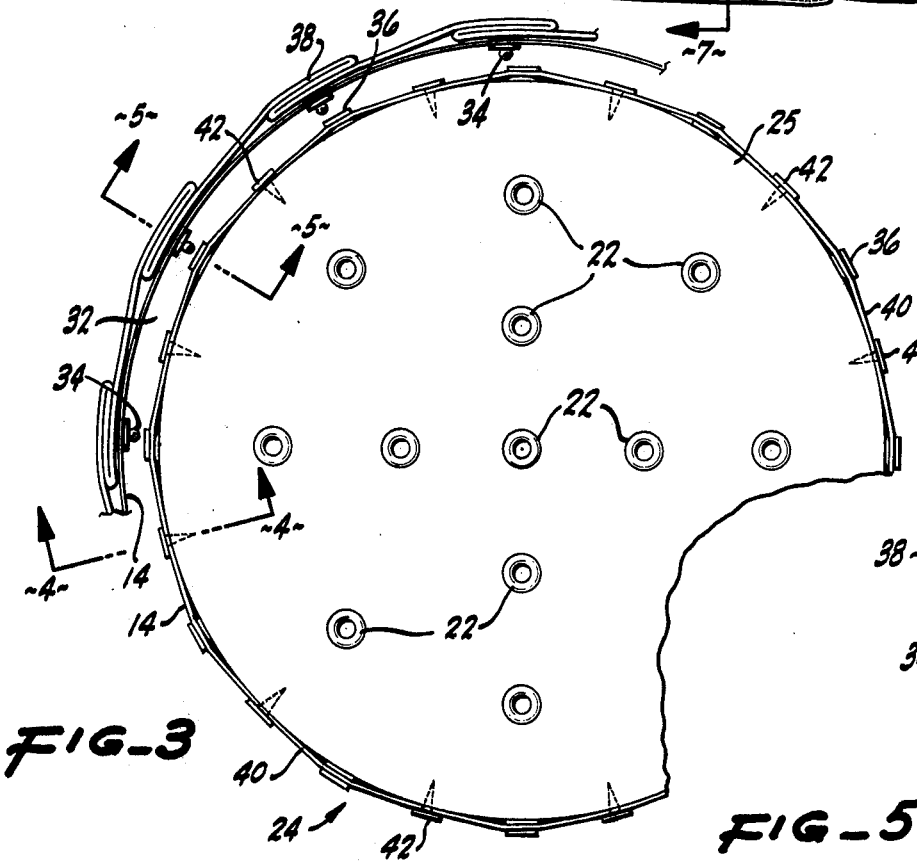
FIG. 3 is a broken plane view of the sorting means.
Figure 4:
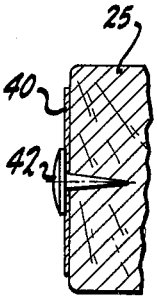
FIG. 4 is a broken cross-sectional view along line 4—4 of FIG. 3.
Figure 5:
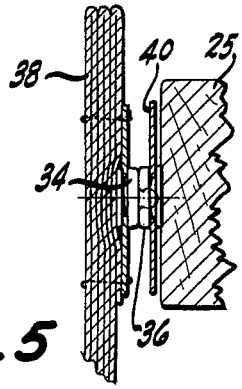
FIG. 5 is a broken cross-sectional view along line 5—5 of FIG. 3.

Referring to FIG. 5, backing strip 38 may be constructed of flexible material to cover the back of male snap members 34 and protect snagging of the snap 34 with objects in the vicinity of the sorter 10. Female snap members 36 may be retained to sorting means 24, as shown in FIGS. 3, 4, and 5 by a tension band 40. Fastening means 42 holds the band 40 snugly against sorting member 25. Thus, the sorting means is removable from the mouth 32 of bag 14.

A plurality of openings 22 are positioned within sorting means 24 to allow yarn-like material 20 to pass from the inside to the outside of bag 14 free of tangle.

The user of the yarn-like material 20 easily employs the same without unnecessary work and the associated frustration. Eyelets 21 disposed within the plurality of openings allow the smooth travel of yarn-like material 20.

FIG. 8 shows the containment of the bulk skeins 44 of the yarn-like material 20 with the use of holding means 46 such as elastic bands. As viewed, FIG. 8 is turned upside-down from the sorter 10, illustrated in FIGS. 1 and 2. As such, the bag 14 of the sorter 10 may be separated and closed by the access openings 28 and 30. These closeable access openings 28 and 30 include zippers, buttons, or, as shown in the drawings, hook strips 48 and 54 and pile strips 50 and 52.

One can readily see that the bulk skeins 44 need not be unwound and rewound into balls before use since the device allows use of the skeins in the configuration normally found when purchasing the same. Although the sorting means 24 is preferably removable from the mouth 32 of bag 14, the closeable access openings 28 and 30 permit the installation of a permanent sorting means 24. FIG. 6 depicts the detail of opening 28 in relation to skeins 44. As shown, the hook strip 54 and pile strip 52 are affixed to the folded-over bag end portions 56. A similar construction is shown for the affixing of hook strip 48 and pile strip 50 to bag end portions 58, most clearly shown in FIG. 7.

Turning to FIG. 9, an alternate embodiment is shown with sorting means 60 comprising a series of loops 62 mounted to the bag 14. The bag 14 may be pleated, as shown in FIG. 10, to allow unrestrained closing of the mouth 32 of the bag 14. A means 64 for substantially enclosing the sorting means 60 may take a variety of forms, but as shown in FIG. 10 includes a cord 66 with enlarged ends 68 threaded through a plurality of openings 72. Grommets 70 prevent the raveling of bag 14 during the opening and closing of mouth 32.

In operation, the user either removes sorting means 24, or in the case of the embodiments shown in FIGS. 9 and 10, loosens cord 60 to place the skeins 44 in place behind holding means 46. In both embodiments, the user may maneuver the skeins into place by separating hook strips 48 and 54 from pile strips 50 and 52. Thus, skeins' 44 placement is effectuated through openings 28 and 30. The free ends of yarn-like material 20 are pulled through openings 28 or through loops 62 to the exterior of the bag 14 for use. It should be noted that more than one free end of the yarn-like material 20 may be conducted through any loop 62 or 28, such as performed in crocheting. The yarn-like material 20 may be pulled through openings 28, in particular, with a crochet hook or like implements. The user now freely manipulates the yarn-like material by employing the tools removed from pockets 16 and 26. The workpiece stores in pocket 18. Grasping of handle structure 12 allows manual carrying of the device 10.

While in the foregoing specification embodiments of the invention have been set forth in considerable detail for purposes of making a complete disclosure of the invention it will be apparent to those skilled in the art that numerous changes may be made in such details without departing from the spirit and principle of the invention.

What is claimed is:

1. A device for the sorting, storage and transportation of yarn-like material, such as cord, thread, line and the like, tools and other paraphernalia comprising:

a. a bag containing a plurality of elongated yarn-like material skeins including means for holding the skeins, said holding means mounted about the skeins intermediate the ends thereof for fixedly securing the same against a portion of the interior of said bag, said holding means permitting access to and relative movement of the free ends of the skeins, b. means for sorting the free ends of said yarn-like material including a sorting member disposed in a portion of the body of said bag and having a plurality of openings for separating and guiding the free ends of the skeins from the interior to the exterior of said bag, the skeins being readily available to the user.

2. The device of claim 1 in which said holding means comprises an elastic band fixed at both ends to a portion of the interior of said bag.

3. The device of claim 1 in which said bag further includes a plurality of closeable access openings permitting manipulation of the yarn-like material skeins contained within said bag.

4. The device of claim 3 in which said plurality of openings for separating and guiding the free ends of the skeins include eyelets disposed in each of said plurality of openings and said plurality of closeable access openings include a first closeable access opening along substantially the entire side portion of said bag and a second closeable access opening along substantially the entire bottom portion of said bag, and further comprising a handle structure to allow manual carrying of said device.

5. The device of claim 4 in which said holding means comprises an elastic band fixed at both ends to a portion of the interior of said bag.

6. The device of claim 1 which further includes a plurality of exterior pockets disposed to hold tools and other paraphernalia employed in the use of the yarn-like material.

7. The device of claim 6 in which said bag has a mouth and said means for sorting is disposed within said mouth.

8. The device of claim 7 in which said means for sorting is removably secured to the periphery of said mouth.

9. The device of claim 8 in which said means for sorting is of rigid construction.

10. The device of claim 8 which further comprises a means for substantially enclosing said means for sorting within said bag.

* * * * *